United States Patent [19]

Maeda

[11] 4,174,593

[45] Nov. 20, 1979

[54] ABRASIVE BLASTING MACHINE

[76] Inventor: Riichi Maeda, 30-1, Kitakata 2-chome, Ichikawa-shi, Chiba, (272), Japan

[21] Appl. No.: 855,466

[22] Filed: Nov. 28, 1977

Related U.S. Application Data

[63] Continuation-in-part of Ser. No. 677,785, Apr. 16, 1976, Pat. No. 4,064,661.

[30] Foreign Application Priority Data

Dec. 10, 1976 [JP] Japan ..... 51-147650

[51] Int. Cl.[2] ..... B24C 5/06

[52] U.S. Cl. ..... 51/435

[58] Field of Search ..... 51/424, 434, 435; 239/224

[56] References Cited

U.S. PATENT DOCUMENTS

| | | | |
|---|---|---|---|
| 3,034,262 | 5/1962 | Pawlson | 51/424 |
| 3,872,624 | 3/1975 | Ramaswamy | 51/435 |
| 3,916,568 | 11/1975 | Rose et al. | 51/429 |
| 3,977,128 | 8/1976 | Goff | 51/424 |

FOREIGN PATENT DOCUMENTS

| | | | |
|---|---|---|---|
| 400099 | 10/1941 | Canada . | |
| 559084 | 2/1975 | Switzerland | 51/435 |

*Primary Examiner*—Harold D. Whitehead
*Assistant Examiner*—Robert P. Olszewski
*Attorney, Agent, or Firm*—Cushman, Darby & Cushman

[57] ABSTRACT

An abrasive blasting apparatus comprising: supply means for supplying abrasive particles, and a rotatable impeller for blasting the abrasive particles supplied from this abrasive supply means onto a workpiece, the impeller having a plurality of vanes arranged in mutually spaced relationship around a rotation axis of the impeller, each of the vanes having a surface containing a first axis inclined with an angle of 25°-65° relative to said rotation axis and a second axis inclined with an angle of 40°-80° relative to an axis perpendicular to said rotation axis, each of the vanes having a first end edge and a first side edge which are located close to said rotation axis and also a second end edge and a second side edge which both face said first end edge and said first side edge, respectively, and also having a third edge positioned between said first end edge and said first side edge and crossing these first end and side edges, the crossing point of said first end edge and said second side edge being either in agreement with the cross point of said third edge and said first end edge or located between a crossing point of said first end edge and said third edge and a crossing point of said first side edge and said third edge relative to said rotation axis, said supply means supplying the abrasive particles from said thrid edge onto said surface which is arranged to have either a flat plane, a plurality of planes or a single curved surface.

13 Claims, 8 Drawing Figures

ABRASIVE BLASTING MACHINE

CROSS REFERENCE TO RELATED APPLICATION

The present application is a continuation-in-part application of the U.S. patent application Ser. No. 677,785 filed on Apr. 16, 1976, issued on Dec. 27, 1977 as U.S. Pat. No. 4,064,661.

BACKGROUND OF THE INVENTION

The present invention relates to an abrasive blasting apparatus, and more particularly, it concerns an abrasive blasting apparatus of the axial flowing type in which the abrasive particles are blasted in the directions along the rotation axis of the impeller of this apparatus.

SUMMARY OF THE INVENTION

It is the primary object of the present invention to provide a axial flow type abrasive blasting apparatus which, in spite of having extremely wide blasting angle, the angles as well as the directions of beams of abrasive particles being blasted are substantially equal and uniform, and which is quite compact in size and light in weight.

Another object of the present invention is to provide an abrasive blasting apparatus of the type described, which is capable of using fine particles of abrasive.

Still another object of the present invention is to provide an abrasive blasting apparatus of the type described above, which is capable of re-circulating the abrasive particles once blasted, and of collecting such blasted abrasive particles without requiring these particles to travel through any detoured passages provided outside the apparatus.

These and other objects as well as the features and advantages of the present invention will become apparent by reading the following detailed description of the present invention.

The axial flow type blasting apparatus according to the present invention has a rotatable impeller for blasting abrasive particles onto a workpiece and a supply means for supplying abrasive particles to the vanes of the impeller. The impeller has a plurality of vanes which are provided at intervals relative to each other about the rotation axis of the impeller. Each of these vanes has a surface containing a first axis which forms a sharp angle $\alpha$ relative to the rotation axis and a second axis which forms a sharp angle $\beta$ relative to an axis crossing said rotation axis at right angle. The surface of each vane has a first end edge and a first side edge both of which are located close to said rotation axis, and a second end edge and a second side edge facing said first end edge and said first side edge, respectively, and a third edge which is positioned between said first end edge and said first side edge and crossing these first end and side edges. In addition, the point of cross of said second side edge and said first end edge is either in agreement with the cross point of said third edge and said first end edge or located between this latter cross point and the point of cross of said third edge and said first side edge.

In case the surface of each vane is constructed so as to have a single plane, this surface will lie in a plane containing the first and the second axes which will be defined below. The geometrical center line lying on the surface of this vane is usually defined as a first axis, and a line which crosses this center line and further crossed the rotation axis at right angle is defined as a second axis. In such vane, abrasive particles are supplied from said third edge onto the surface of the vane. The abrasive particles supplied are caused to move, while being confined onto the vane surface by a component of a centrifugal force produced by the rotation of the vane, in a direction associated with the angles $\alpha$, $\beta$ of the surface of the vane and with the velocity of movement of the abrasive particles. From the entire second end edge of the vane, the abrasive particles are blown in a direction of a summed-up vector of (a) the peripheral speed of those portions of the vane located at the above-said entire edges and (b) the velocity of movement of the abrasive particles. The second end edge of the vane has greater peripheral speeds as compared with those of the first end edge and the first side edge. Since the velocity of the abrasive particles is substantially the same for all portions of the vane surface, the particles of abrasive which are blown onto the workpiece will assume a circular pattern. And, the angle which the beam of the abrasive particles blasted onto the surface of the workpiece assumes relative to this latter surface can be made substantially uniform by an appropriate selection of the angles $\alpha$ and $\beta$.

Also, a more uniform angle of blast of the beam of abrasive particles may be obtained by constructing the vane surface to have a plurality of planes, and thus a broader area of blast can be obtained. The respective planes are arranged basically so as to have the aforesaid first and second axes. In other words, each of these planes is constructed so as to be similar to that for the instance of a vane having a single plane. Preferably, the number of such planes, generally, is an odd number. In case of an odd number of planes, the one located centrally on the surface of the vane is constructed in a manner similar to that for a single plane, as described above. Those planes which flank this central plane desirably are constructed in such manner that their aforesaid first side edges and second side edges will define the aforesaid first axis, and the line which crosses these side edges and crosses the rotation axis at right angle will define the aforesaid second axis.

Furthermore, the surface of the vane may be formed to have a curved surface to further improve the blasting angle, area of blast and so forth. Such curved surface may be defined as indicating an instance wherein the number of a plurality of planes in a surface is indefinitely great. Therefore, a line located on the surface of the vane and crossing the rotation axis, i.e. a generating line relative to the surface of the vane, constitutes said first axis, and a line which is tangential to the surface of the vane at the point of cross of said generating line and an axis perpendicular to the rotation axis constitutes said second axis. Such an arbitrary tangential line lying on the surface of the vane will form the same uniform angle $\beta$ relative to the said perpendicular line. The surface which consists of a curved face may be defined also that the plane which is tangential to an arbitrary point lying on the surface of the vane forms a same uniform angle $\alpha$, and that this tangential plane will form a same uniform angle $\beta$ relative to said perpendicular axis.

Based on such curved surface of the vane as discussed above, there may be formed a surface such that its end edges located closer to the rotation axis form an angle $\beta$ relative to the rotation axis, and that their opposingly-located end edges form an oppositely directed angle $-\beta$, and that the angle located between these two angles and relative to an axis perpendicular to the rotation axis will become zero. Furthermore, there may be formed a surface such that the angle $\beta$ at the end edges located closer to the rotation axis becomes substantially zero and that this angle $\beta$ will become progressively greater so as to form an angle $\beta$ at the opposingly located end edges. In such an instance, the angle formed at the end edges which are located closer to the rotation axis will be forced to assume a certain angle on account of various restrictive factors. These various types of surface will adopted depending on the purpose of use of the apparatus, the type of the abrasive used, and so forth.

In a vane as has been discussed above, the angle $\alpha$ of the surface of the vane desirably is in the range of 25°-65°, and the angle $\beta$ desirably is in the range of 40°-80°. Preferred angles are: $\alpha=45°$ and $\beta=60°$.

In the blasting apparatus according to the present invention, the abrasive particles are supplied from around the rotation axis toward the edge portions and onto the surface of the vane. The abrasive particles supply means may have any arbitrary structure. In the impeller of the present invention, it is possible to arrange so that the blasted particles abrasive are returned to the impeller or re-circled within the blasting apparatus. Such returning or re-circulation of abrasive particles which have been blasted once can be carried out by causing the abrasive particles which are rebouncing from the surface of the workpiece to ride on the air flow or air current which travels from the surface of the workpiece toward the center of the impeller. In the embodiment of the present invention, there is provided a cover member around the impeller so as to be spaced from the vanes, and an air passageway or air passageways are provided between the vanes and the inside wall of the cover member. The cover member is provided, between it and the worpiece, with a sealing member which permits air to pass therethrough, such as a brush-like member or a flexible rubber-like plate having slits for allowing the passage of air. An air path is formed around the rotation axis. Air is sucked through this air path. Thus, the aforesaid air flow or air current is formed by these air passageways and air path. The inside wall of the cover member has a surface which allows the particles of abrasive which have been reflected on rebouncing from the workpiece to be caused to ride on the air flow. In the vicinity of the center of the vane is provided a separator to separate air from abrasive particles. This separator may be an impeller which is provided co-axially with the vane, or it may be a net which crosses the air flow, or further it may be a reflector plate positioned in the air flow and having a surface which is of such an angle as to be able to supply the abrasive particles onto the surface of the vane. Alternatively, the separator may be a combination of these members.

DETAILED DESCRIPTION OF THE PREFERRED EMBODIMENTS

Figure 1:
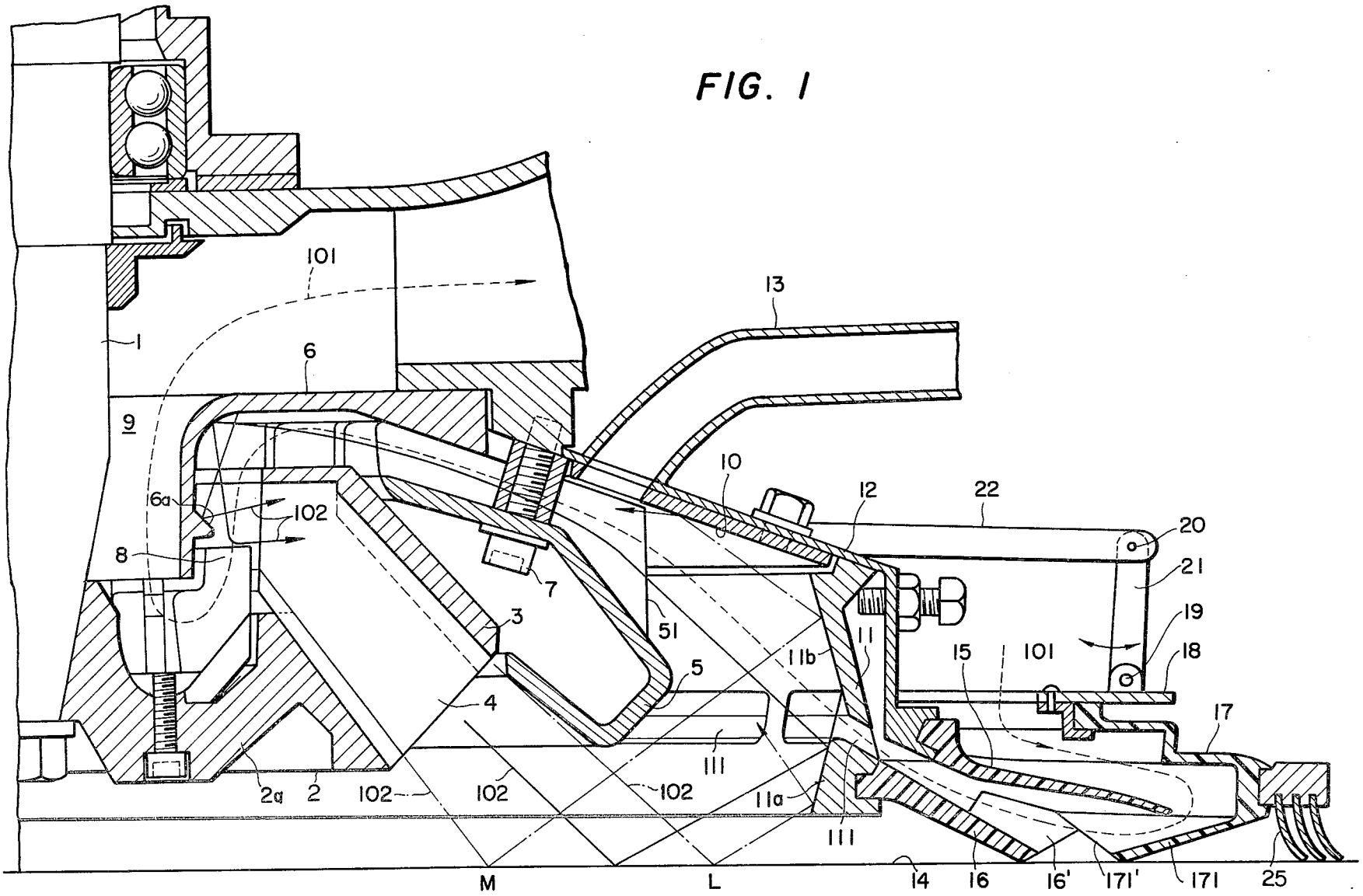
FIG. 1 is a longitudinal sectional view of the abrasive blasting apparatus according to the present invention; the one half which is omitted in this Figure has the construction symmetrical with the other half.
Figure 2:
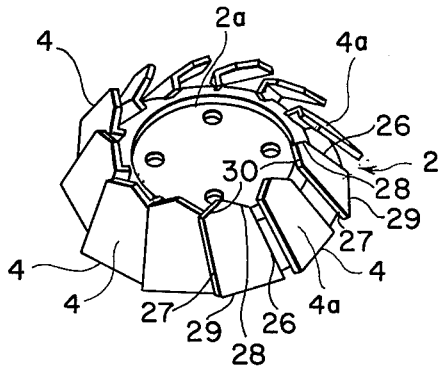
FIG. 2 is a perspective view of an impeller employed in the present invention, showing its state that its outer ring member covering this impeller is removed.
Figure 3:
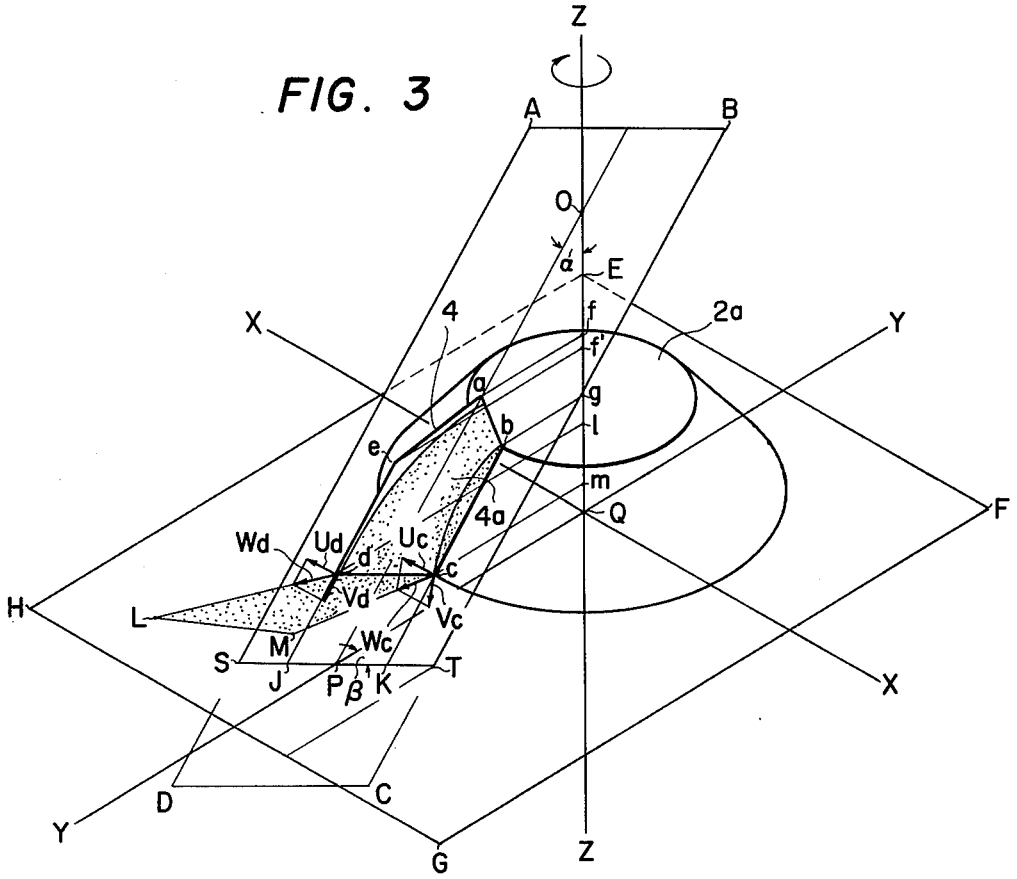
FIG. 3 is an explanatory illustration showing the configuration of a vane of the impeller.

FIG. 1 is a longitudinal sectional view showing a part of the abrasive blasting apparatus according to the present invention. The leftside half of this apparatus which is omitted in this Figure is constructed so as to be substantially symmetrical with the rightside half. In this Figure, a spindle 1 is arranged within this apparatus, and is rotatably supported on a frame by a bearing. This spindle is arranged so as to be rotated by an electric motor not shown. An impeller 2 has an inner wheel 2*a* of a conical outer surface which is fixed to the lower end of the spindle 1, and an outer wheel 3 of a conical inner surface which is provided around said inner wheel 2*a* with space therefrom. In this space are disposed a plurality of vanes 4 at mutually equally spaced relationship. In addition, as illustrated in FIG. 2, the inner or first side edge 26 of the vane is fixed to the inner wheel and the outer or second side edge 27 of the vane is fixed to the outer wheel, respectively, either by welding or by fitting such edges into the grooves formed in the inner and the outer wheels, respectively. As shown in FIGS. 2 and 3, each vane 4 has a surface 4*a* consisting of a single plane. This surface 4*a* is arranged so as to be inclined by forming a sharp angle relative to the center of rotation of the spindle, i.e. the rotation axis, and along therewith said surface 4*a* is inclined by forming a sharp angle relative to an axis which crosses the rotation axis at right angle. These positional relationship will hereunder be explained in further detail by referring to FIG. 3. In this Figure, a plane ABCD contains an axis OP which is arranged so as to form a sharp angle $\alpha$ relative to the rotation axis ZZ. At the same time therewith, this plane ABCD crosses a horizontal plane EFGH which is an imaginary surface to be processed. The crossing line JK of the plane ABCD and the plane EFGH, or the projection line JK of this plane ABCD onto said imaginary horizontal plane EFGH, forms an angle $\beta$ relative to an axis YY which is contained in the plane EFGH. The surface 4*a* is positioned above the plane ABCD. For this reason, the surface 4*a* is inclined by forming angles $\alpha$ and $\beta$ relative to the rotation axis ZZ and the axis YY which crosses the axis ZZ at right angle, respectively. The angle $\beta$ of inclination is defined in a direction opposite to the direction of rotation. Accordingly, the surface of the vane is inclined in a slanting and rearward direction relative to the direction of rotation. The angles $\alpha$ and $\beta$ are determined experimentally. However, these angles preferably are set to lie within the ranges 25°-65° and 40°-80°, respectively. More preferably angles of $\alpha$ and $\beta$ are 45° and 60°, respectivery.

The end edges of the vane located close to the rotation axis form a substantially inverted V shape as shown in FIG. 2 by first end edge 30 and third edge 28. As will be described later, abrasive particles are supplied from the third edge 28 (See FIG. 2) or edge ab which is located closer to the rotation axis onto the surface 4*a*. In the vane of the present invention, the foot f' of the perpendicular leading from a crossing point e to the rotation axis ZZ is positioned either in agreement with the foot f of the perpendicular drawn from the crossing point a to the rotation axis ZZ or with the foot g of the perpendicular drawn from the crossing point b to the rotation axis ZZ, or the foot f' may be located between f and g.

In such vane as described above, the abrasive particles supplied from the edge ab move, while being confined to the surface 4a by the component of the centrifugal force produced as the impeller is rotated, in the direction associated with the angle assumed by the surface 4a and also with the movement velocity of the abrasive particles. Because of the aforesaid arrangement of the crossing point e, however, the path of movement of the abrasive particles is confined within the vane.

The abrasive particles which have arrived at the second end edge 29 (See FIG. 2) or edge dc are blasted in the direction of the summed-up vector Wd of the peripheral speed Ud at point d and the movement velocity Vd of the abrasive particles at point d. Also, the abrasive particles which have arrived in the vicinity of point c are blasted in the direction of the summed-up vector Wc of the peripheral speed Uc at point c and the movement velocity Vc of the abrasive particles at point c. And, in the same way, the abrasive particles are blasted through the entire end edges of the vane. Since the peripheral speed becomes progressively greater as point c moves to point d, and since the movement velocity of the abrasive particles is substantially the same, the pattern of the blasted abrasive particles on the horizontal plane will have either a ring shape or a doughnut shape which is depicted by using the line LM as the width and using the rotation axis as the center of said shape. By appropriately selecting the distances dl and cm and the angles $\alpha$ and $\beta$ of the vane, it is possible to make substantially uniform the angle formed by the beam of abrasive particles being blasted and by the surface of the workpiece being processed.

Figure 4:
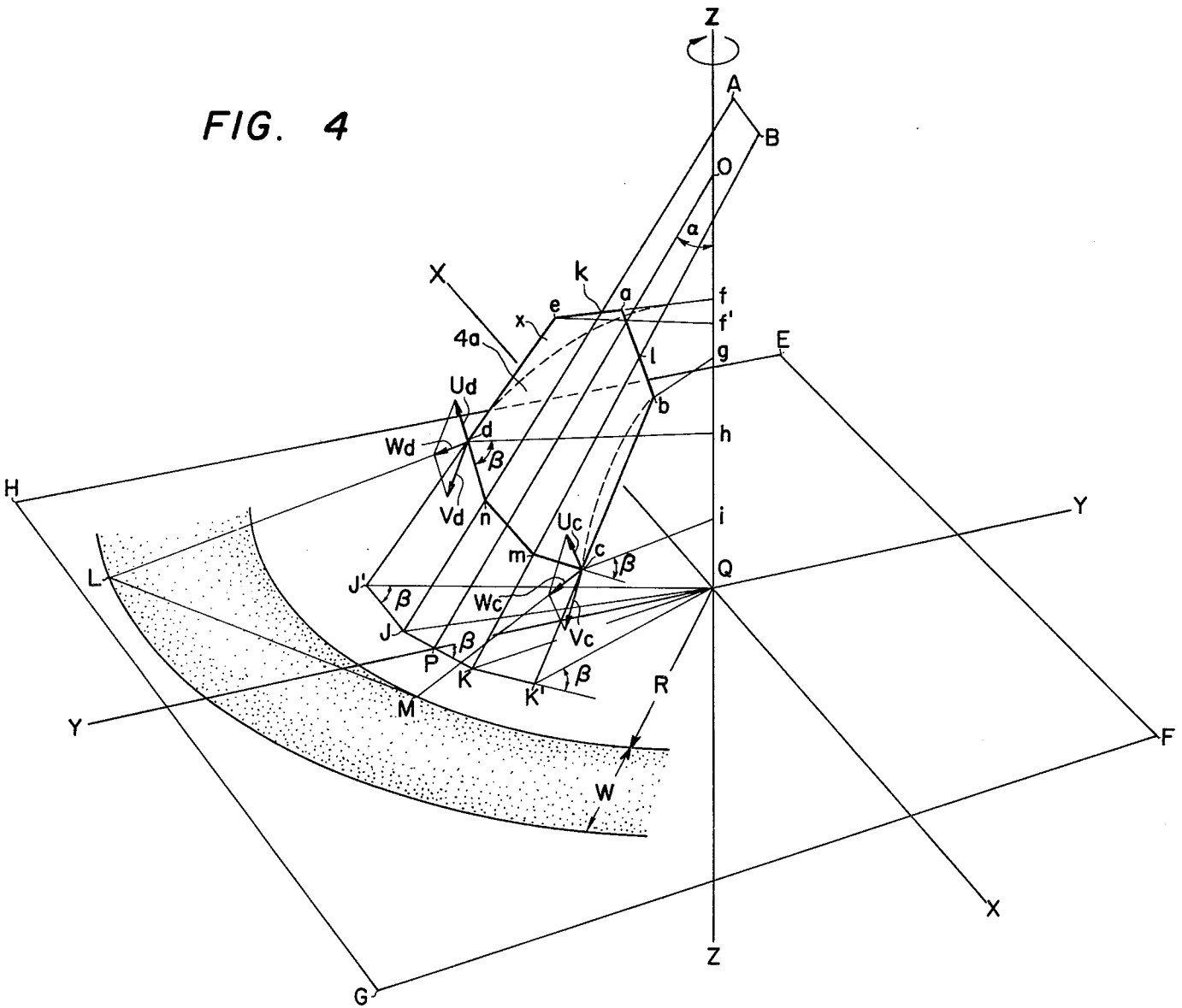
FIG. 4 is an explanatory illustration showing another structure of a vane.

As shown in FIG. 4, the surface of 4a of the vane or the vane per se may have a plural number of planes. Each plane is inclined relative to the rotation axis with a sharp angle, and also it is inclined with a sharp angle relative to an axis crossing this rotation axis at right angle. Such vane further increases the range of area of blast of abrasive particles, and serves to uniformalize the angle formed by the beam of the abrasive particles blasted in this area and by the surface of the workpiece being processed, and in addition it minimizes the wear of the surface of the vane. These relationships will be explained in further detail by referring to the drawings. In the example, the surface 4a of the vane is comprised of three planes. That is, they are the central plane almnk, and the two planes eknd and cblm which flank the central plane. Each of these planes is inclined with a sharp angle $\alpha$ relative to the rotation axis ZZ, and is also inclined with a sharp angle $\beta$ relative to an axis crossing the rotation axis at right angle. More particularly, let us now refer to FIG. 4. In this Figure, the respective planes which constitute the surface 4a of the vane are inclined with a sharp angle $\alpha$ relative to the rotation axis ZZ of the impeller. The plane EFGH crosses at right angle a plane which contains the rotation axis ZZ. This plane EFGH is an imaginary surface to be processed. The projection lines J'J, JK and KK' of the three planes eknd, kalmn and bcml projected onto the plane EFGH, i.e. the crossing lines of these three planes and the plane EFGH, invariably form a same sharp angle $\beta$ relative to axes J'Q, PQ and K'Q which cross the rotation axis ZZ at right angle and which lie on the plane EFGH, respectively. These respective angles $\beta$ of the three projection lines are taken in a direction opposite to the direction of rotation, respectively. Therefore, these three planes are tilted rearwardly relative to the direction of rotation. The angles $\alpha$ and $\beta$ of inclination may be determined experimentally so as to be optimum. However, it is desirable to set the angle $\alpha$ at 25°-65°, and the angle $\beta$ at 40°-80°. And, the angles which will provide a better result is 45° for angle $\alpha$ and 60° for angle $\beta$.

The end edges of the vane which are located closer to the rotation axis form a substantially inverted V-shape. That is, the point of cross e of the edge ea and the edge de is positioned between the apex a and the crossing point b of the end edge ab and the side edge bc. More particularly, the foot f' of a perpendicular drawn from the crossing point e to the rotation axis ZZ is arranged to be positioned between the foots f and g which are drawn from the crossing points a and b to the rotation axis, respectively. Thus, arrangement is made so that the abrasive particles which are supplied from the end edge ab are allowed to move without departing out from the vane.

The abrasive particles which have been supplied to the end edge ab will move, while being confined to the surface 4a as the impeller rotates, in the direction associated with the angles assumed by the respective planes of the vane and with the velocity of movement of the abrasive particles. Thus, the abrasive particles will reach the end edge cmnd which is located on the distal end of the vane. Thereafter, the abrasive particles are blasted onto the workpiece from the entire portions of this end edge. The direction in which the abrasive particles are blasted is in the direction of the summed-up vector of the movement speed of the abrasive particles when they depart from the surface 4a and the peripheral speed thereat. Those abrasive particles which have arrived at point d are blasted in the direction of the summed-up vector of the movement speed Vd of the abrasive particles at this point d and the peripheral speed Ud at point d. Similarly, the abrasive particles at point c are blasted in the direction of the summed-up vector of the movement speed Vc and the peripheral speed Uc. Thus, the abrasive particles are blasted onto points L and M on the imaginary plane EFGH requiring processing, forming a blast pattern of a ring-shape or a doughnut-shape having a width W. The vane having such surface as described above enables one to obtain a wider blast pattern of abrasive particles as compared with the previously described surface of the vane, even where the radius of the impeller is the same. In addition, the vane of this instant example is capable of reducing the wear of the vane. Furthermore, such vane is able to increase the rate of the abrasive particles blasted per unit time.

In the vane shown in FIG. 4, a part or all of the vicinity of the end edges located on that side where the abrasive particles are blasted out therefrom may be constructed to have a curved surface, to insure more uniform density of blast of the abrasive particles.

Figure 5:
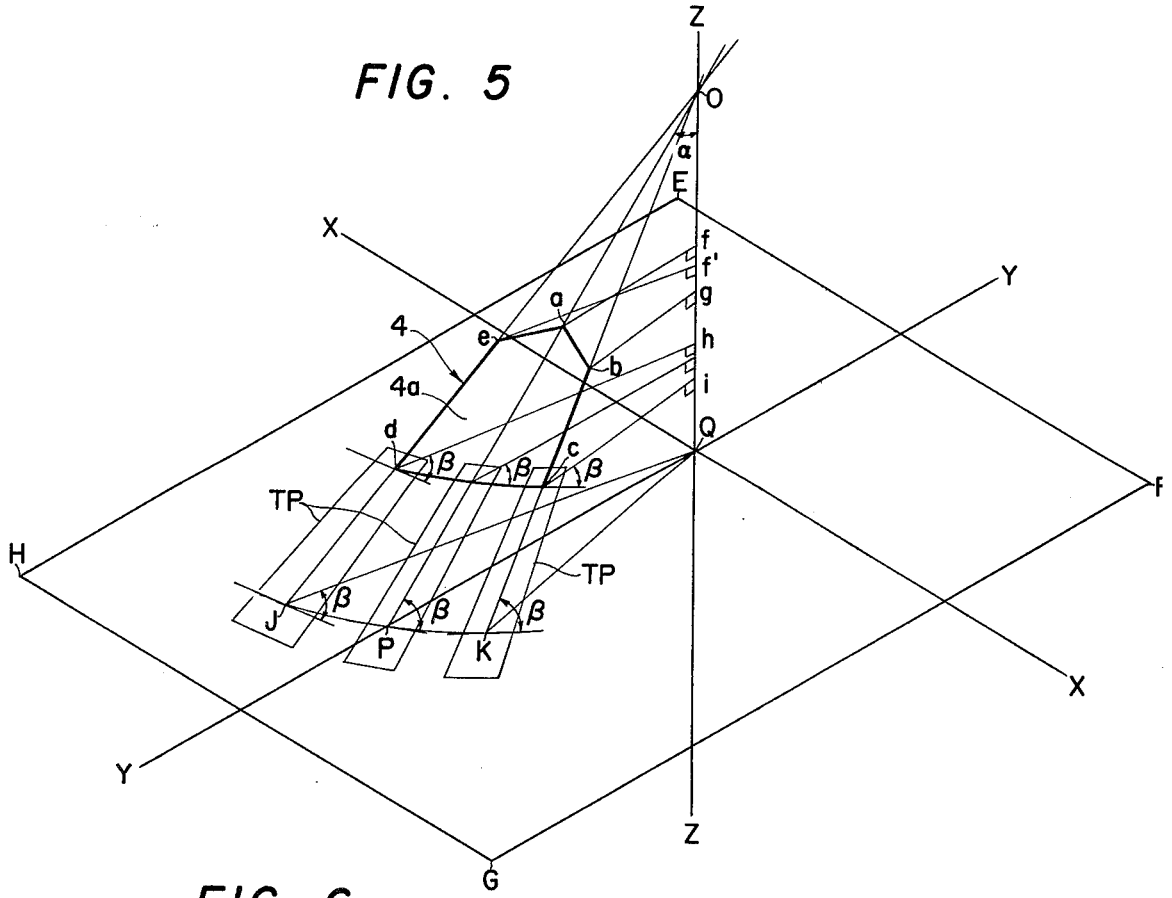
FIG. 5 is an explanatory illustration showing still another structure of a vane.

Furthermore, the entire surface of the vane may be constructed as a curved surface. A vane having a surface consisting of a curved surface may be defined that, in a vane having a surface consisting of a plurality of planes, the number of the planes is made indefinite. For this reason, the curved surface will be noted to include all planes located around the rotation axis, said planes invariably being inclined at a sharp angle $\alpha$ relative to the rotation axis and also inclined at a sharp angle $\beta$ relative to axes crossing the rotation axis at right angle. Alternatively, as shown in FIG. 5, the tangential TP relative to arbitrary points on the surface 4a invariably have the same angle $\alpha$ relative to the rotation axis ZZ and have the same angle $\beta$ relative to the axes crossing the rotation azis ZZ at right angle. With respect to the angle $\beta$, it may be defined also that the tangential lines for the projection line of the surface 4a projected onto the imaginary plane EFGH invariably form the same angle $\beta$ relative to the axes crossing the rotation axis at right angle. The angles $\alpha$ and $\beta$ preferably are 25°–65° and 40°–80°, and more preferably they are: $\alpha=45°$ and $\beta=60°$, as in the vanes of other designs described. Such vane enables the abrasive particles to be blasted more smoothly in addition to the advantages obtained from the vane shown in FIG. 4.

In such a vane having a surface consisting of a curved surface, those end edges located closer to the rotation axis are constructed so as to have a substantially inverted V-shape as in the vanes discussed previously in connection with FIGS. 3 and 4. This arrangement of the end edges will be clearly understood without requiring further explanation.

The impeller preferably is constructed together with an abrasive particles supply means or an supply-recirculation means as illustrated. A further detailed explanation will be made hereunder be referring to FIG. 1.

A guide ring 5 is constructed so as to cover the outer circumference of the impeller which, in turn, is constructed with an outer wheel 3 and vanes 4. On the upper surface of the guide ring 5 extend upright a number of guide plates 51 spaced from each other at appropriate intervals. A partition wall 6 is arranged to extend from around the center of rotation of the impeller to around the guide ring 5. The guide ring 5 is supported within the apparatus by a bolt 7 and a spacer. The inner surface of this partition wall 6, along with the outer surface of the guide ring 5, constitutes an air passageway which will be described later. A deflector plate 8 is so arranged as to be positioned on the inside of the vane and also to be positioned around the rotation axis, and is rotatable with the impeller. A space 9 is defined between the outer surface of the guide plate 51 and the rotation axis 1, and this space 9 is communicated with a vacuum source not shown.

An upper lining 10 is provided in contiguous relationship with the partition wall 6. Together with a lateral lining 11 which is provided contiguously with said upper lining 10, this latter lining 10 is fixed to the cover member of the body of the apparatus by fastening means such as bolts. By these members, an outer cover unit for covering the impeller and the guide ring is constructed. An abrasive particles supply pipe 13 opens into the upper lining 10.

The lateral lining 11 has two reflecting surfaces 11a and 11b which are provided with such angles that the abrasive particles which have been blasted out from the blade 4 and which thereafter impinge onto the surface 14 of the workpiece and are reflected (bounce) therefrom can be re-reflected (caused to rebounce) between the guide ring 5 and the upper lining 10. Also, an external air inlet 111 is provided at the interface between these two reflecting surfaces 11a and 11b. This external air inlet 111 is arranged to open throughout the entire circumference of the impeller, and it is provided locally in its opening with a bridge means at, for example, every 30°.

The cover member 12 has a circumferential wall which is positioned around the lateral lining 11. The peripheral end portion of this cover member 12 depends downwardly as shown to fix thereto and also to the end portion of the lateral lining 11 the inner circumferences of an inner upper sealing plate 15 and an inner lower sealing plate 16, respectively, which are comprised of an elastic material such as rubber. These inner upper and lower sealing plates 15 and 16 are so arranged that the interval between the inner peripheral ends of the seals 15 and 16 is in agreement with the external air inlet 111 of the lateral lining member 11. Furthermore, the sealing plate 15 extends for a substantial length in the outer direction beyond the outer end of the sealing plate 16. A plurality of interval-maintaining pieces 16' erect in the circumferencial direction of the apparatus from that surface of the sealing plate 16 which faces the sealing plate 15, with an appropriate interval between each adjacent pieces 16'.

An outer sealing plate 17 is supported by a suspension ring 18. The suspension ring, in general, is fixed to the cover member. However, the suspension ring 18 employed in the present invention desirably is suspended for pivotal movement by a link 21 via a pin 19, as shown, and this link 21, in turn, desirably is supported by a fixed arm 22 by a pin 20. The outer sealing plate 17 has a shape for surrounding the sealing plates 15 and 16, and has at the distal end of its outer lateral wall a contact piece 171 extending between the upper and the lower sealing plates 15 and 16. This contact piece 171 extends up to that extended portion of the inner upper sealing plate 15, and a plurality of interval-maintaining pieces 171' erect from the upper surface of the distal end portion of this extended portion of the contact piece 171 to be inserted between the adjacent interval-maintaining pieces 16' erecting from the surface of the inner lower sealing plate 16. A plurality of flexible sealing plates 25 are provided further on the outer side of the outer sealing plate 17.

In operation, the abrasive blasting apparatus according to the present invention is set above that surface 14 of the workpiece which is subjected to blasting, in such a manner that the free ends of the inner lower sealing plate 16 and the outer sealing plate 17 are brought into contact with said surface 14 of the workpiece requiring blasting. While exhausting air through the space 9, abrasive particles are supplied from the abrasive particles supply pipe 13. Whereupon, the abrasive particles are conveyed on an air current as shown by the chain line in FIG. 1, and the abrasive particles are blasted onto the surface 14 of the workpiece, and along therewith the abrasive particles which have hit said surface 14 are re-circulated. Thus, it is possible to perform a continuous blasting operation with good efficiency.

In operation, the air which has been admitted into the apparatus through the external air inlet 111 passes, as shown by the dotted line in FIG. 1, in the air passageway defined between the upper lining 10 and the guide ring 5, and then the direction of this air current is altered as it is hit by the partition wall 6, and thus the air is exhausted through the interval 9. The abrasive particles which have been conveyed on the air current are fed to the end edge of the vane by either one or both of the inclined wall surface 6a of the inner wall surface of the partition wall and the deflection plate 8. The abrasive particles fed to such site are accelerated in their deflection by the rotation of the vane so that the abrasive particles are brought to the outer end edges of the vane.

Figure 6:
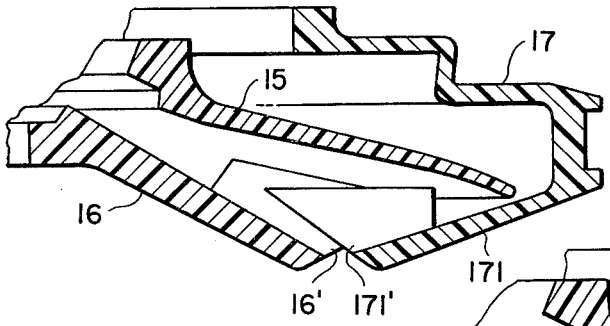
FIGS. 6–8 are enlarged longitudinal sectional views of a sealing member of a re-circulating means employed in the abrasive blasting apparatus of the present invention and showing the operating state of this sealing member.
Figure 7:
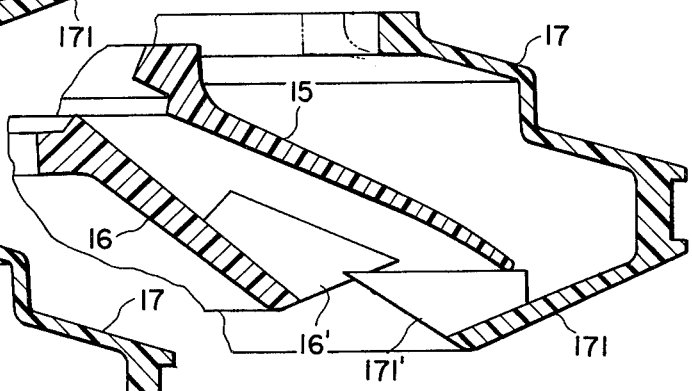
Figure 8:
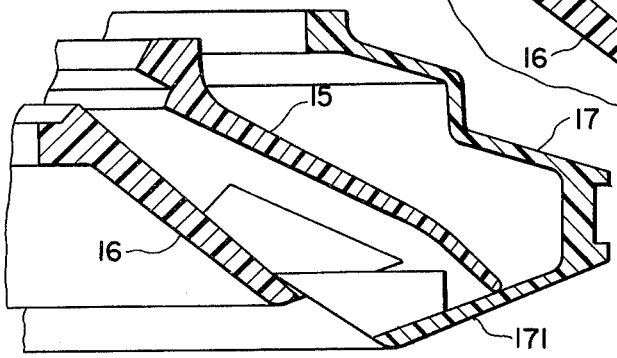

At the delivery end edge(s) of the vane, the abrasive particles are blasted in the direction defined by the summed-up vector of the rotation speed and the accelerated velocity at the surface of the vane. As a result, the abrasive particles are blasted onto the surface of the workpiece in a ring shape having a width of LM. During such movement of the blasting apparatus, those particles of abrasive which are retained on the workpiece surface are also caused to be recirculated to again participate in the blasting-abrasing operation. More specifically, this is carried out by the inner and lower sealing plates 15 and 16, and also by the outer sealing plate 17. Owing to the resistance, against the workpiece surface, of that portion of the outer sealing plate 17 which is located at the distal end of advance of the apparatus, this portion of the outer sealing plate 17 is caused to approach the sealing plates 15 and 16, whereas that portion of the sealing plate 17 located on the side which is opposite or rearward to the advancing side of the apparatus will be caused to move away from these sealing plates 15 and 16. As a result, the opening for communication with external air, defined by those portions of the two sealing plates 16 and 17 located at the advancing side of the apparatus will become narrowed, whereas the opening on the opposite or rear side will become larger. Therefore, there will be an increase in the amount of air introduced through the opening at the rear or trailing side of the apparatus. Thus, those abrasive particles which have been spilled outside the sealing plate 16 are sucked by the air introduced through the rear-side opening no sooner than they arrive at the space formed between the sealing plate 16 and the contact piece 171. The sucked-up abrasive particles are then supplied again to the impeller to participate in the blasting operation. The inner upper and lower sealing plates 15, 16 and the outer sealing plate 17 are provided throughout the entire circumference of the impeller. Accordingly, it will be understood that, irrespective of the directions in which the blasting apparatus is moved, it is possible to carry out similar blasting operations. When the blasting apparatus is lifted upwardly from its stationary position shown in FIG. 1, i.e. when the apparatus is lifted up from the surface of the workpiece, the respective sealing plates 15, 16 and 17 are rendered to their state shown in FIG. 6. Those sealing plates 15, 16 and 17 located on the trailing side of the apparatus will assume their state as shown in FIG. 7 during the advancing of the apparatus, whereas those sealing plates 15, 16 and 17 located on the advancing or leading side of the apparatus will assume their state as shown in FIG. 8. If required, the space between these sealing plates 15, 16 and 17 may not be so arranged as to be displaced automatically.

What is claimed is:

1. An abrasive blasting apparatus comprising:

an abrasive particles supply means and a rotatable impeller for blasting onto a workpiece the abrasive particles supplied from said abrasive particles supply means, said impeller having around its rotation axis a plurality of vanes provided at spaced relationship relative to each other, each of said vanes having a surface containing a first axis inclined at an angle of 25°–65° relative to the rotation axis and containing a second axis inclined at an angle of 40°–80° relative to an axis crossing the rotation axis at right angle, said vane having a first end edge and a first side edge which are positioned closer to the rotation axis, and also having a second end edge and a second side edge which face said first end edge and first side edge, respectively, and further having a third edge located between said first end edge and said first side edge and crossing these two edges, the projection of the intersection of said first end edge and said second side edge onto said rotation axis being positioned between the same projection of the intersection of said first end edge and said third edge and the intersection of said first side edge and said third edge, whereby said abrasive supply means supplies abrasive particles from said third edge onto said surface.

2. An abrasive blasting apparatus according to claim 1, in which: said surface is comprised of a single plane.

3. An abrasive blasting apparatus according to claim 1, in which: said surface is comprised of a curved surface, and a tangential line passing at an arbitrary point on said curved surface constitutes said second axis.

4. An abrasive blasting apparatus according to claim 1, in which: said surface is comprised of a plurality of planes, and each of these planes contains both of said first and second axes.

5. An abrasive blasting apparatus according to claim 4, in which: said surface located in the vicinity of said second end edge is curved.

6. An abrasive blasting apparatus comprising:

an abrasive particles supply means and a rotatable impeller for blasting the abrasive particles supplied from said supply means onto a workpiece, said impeller having around its rotation axis a plurality of vanes provided at spaced relationship relative to each other, each of said vanes having a surface consisting of a curved surface, a tangential plane passing at an arbitrary point on this curved surface forming an angle of 25°–65° relative to the rotation axis, and also forming an angle of 40°–80° relative to an axis crossing the rotation axis at right angle, said vane having a first end edge and a first side edge which are located closer to the rotation axis, and also having a second end edge and a second side edge which face said first end edge and second side edge, respectively, and further having a third edge located between said first end edge and said first side edge and crossing these two edges, the projection of the intersection of said first end edge and said second side edge onto said axis of rotation being positioned between the same projection of the intersection of said first end edge and said third edge and the crossing point of said first side edge and said third edge, whereby said abrasive particles supply means supplies abrasive particles from said third edge onto said surface.

7. An abrasive blasting apparatus according to claim 1, in which: said abrasive particles supply means comprising:

guide means provided between said spindle and said first edge of said vane;

deflector means provided between said spindle and said impeller;

an air current path consisting of a space formed between said spindle and said guide means and being communicated with a suction means, another space communicated with said space and being formed between said impeller and said guide means, and a further space formed between inner space on the inside of a cover means, said cover means and the workpiece;

an inner surface of said cover means for causing those blasted abrasive particles re-bouncing from the workpiece to ride on said air current; and sealing means located in a space formed between said cover means and said workpiece and provided on said cover means.

8. An abrasive blasting apparatus according to claim 7, further comprising:

further guide means positioned between an outer wheel of said impeller and the inner surface of said cover means, said inner surface of the cover means and said further guide means forming a passageway in the inner space of said cover for being communicated with said air current path.

9. An abrasive blasting apparatus according to claim 8, in which: said sealing means comprising an inner sealing member and an outer sealing member, said inner sealing member being comprised of two sealing rings arranged at a space relative to each other and being capable of closing this a space, said outer sealing member causing said inner sealing member to open in association with a travel of said apparatus.

10. An abrasive blasting apparatus according to claim 9, in which: said outer sealing member has a block capable of moving said one of the two sealing rings in association with the travel of the apparatus.

11. An abrasive blasting apparatus according to claim 7, in which: said guide means has a projection located between the third edge of said vane and this guide means, and this projection has a surface inclined toward said third edge of said vane, whereby this surface causes the abrasive particles carried on said air current to be reflected onto said third edge of said vane.

12. An abrasive blasting apparatus according to claim 9, in which: said cover means has a further outer sealing member located around said outer sealing member, and this further sealing member has a plurality of flexible sealing elements which are arranged at a space relative to each other.

13. An abrasive blasting apparatus according to claim 7, in which: said cover means has a supply pipe means for supplying abrasive particles for communication with said current path.

* * * * *